US007241218B2

(12) United States Patent
Van Becelaere et al.

(10) Patent No.: US 7,241,218 B2
(45) Date of Patent: Jul. 10, 2007

(54) FIRE/SMOKE DAMPER CONTROL SYSTEM

(75) Inventors: Robert Van Becelaere, Lake Lotawana, MO (US); Thomas Edwards, Leawood, KS (US)

(73) Assignee: Ruskin Company, Kansas City, MO (US)

( * ) Notice: Subject to any disclaimer, the term of this patent is extended or adjusted under 35 U.S.C. 154(b) by 200 days.

(21) Appl. No.: 10/838,736

(22) Filed: May 4, 2004

(65) Prior Publication Data

US 2004/0224627 A1 Nov. 11, 2004

Related U.S. Application Data

(60) Provisional application No. 60/468,335, filed on May 6, 2003.

(51) Int. Cl.
*A62C 2/12* (2006.01)

(52) U.S. Cl. ..... 454/369

(58) Field of Classification Search ..... 454/369; 126/502, 504, 536, 538
See application file for complete search history.

(56) References Cited

U.S. PATENT DOCUMENTS 4,818,970 A * 4/1989 Natale et al. ..... 340/539.26
5,350,019 A * 9/1994 Igarashi ..... 169/61
5,446,677 A * 8/1995 Jensen et al. ..... 700/277
5,788,571 A * 8/1998 Ivison et al. ..... 454/252
6,014,612 A 1/2000 Larson et al.
6,028,998 A 2/2000 Gloudeman et al.
6,141,595 A 10/2000 Gloudeman et al.
6,377,859 B1 4/2002 Brown et al.
6,473,710 B1 10/2002 Eryurek
6,502,411 B2 * 1/2003 Okamoto ..... 62/129
6,651,952 B1 * 11/2003 Hightower et al. ..... 251/69
2001/0056314 A1 12/2001 Lomonaco et al.
2002/0022991 A1 2/2002 Sharood et al.
2002/0144537 A1 10/2002 Sharp et al.
2002/0152298 A1 10/2002 Kikta et al.

* cited by examiner

*Primary Examiner*—Gregory Wilson
(74) *Attorney, Agent, or Firm*—Calfee, Halter & Griswold LLP

(57) ABSTRACT

A fire/smoke damper control system is provided for use in monitoring and controlling operation of one or more fire/smoke dampers in a building. The system includes a local damper controller associated with each fire/smoke damper for controlling the opening and closing of each fire/smoke damper, a remote router for controlling the operation of one or more local damper controllers, and circuit communication between the remote router and each local damper controller. The control system allows for localized power supply for damper actuation, eliminating the pulling of wire from each damper back to a central power panel.

4 Claims, 6 Drawing Sheets

FIRE/SMOKE DAMPER CONTROL SYSTEM

This application claims the benefit of U.S. provisional patent application No. 60/468,335, filed on May 6, 2003, the entirety of which is hereby incorporated by reference.

This invention relates to the control of dampers used to prevent the spread of fire and smoke within buildings and, more particularly, to a system of local control in communication with one or more central controls having the capacity to communicate with the overall building monitoring and control system.

BACKGROUND OF THE INVENTION

Fire/smoke dampers are used to protect people and property from destruction in buildings in the case of an emergency. A fire/smoke damper is used with a building air handling system as a prevention device for the spread of fire and smoke. Fire/smoke dampers may be designed to meet or exceed Underwriters Laboratories UL555, UL555C, UL555S, National Fire Protection Association, and California State Fire Marshal requirements in walls, ceilings, and floors. In general, these codes require dampers that are able to stop the passage of flames for a period of 1½ or 3 hours and the leakage of smoke for up to 177° C. (350° F.) in smoke-laden air.

Fire/smoke dampers differ from HVAC dampers in their overall design and materials of construction, including use of materials that are able to withstand high temperature. Fire/smoke dampers are also subject to different testing than HVAC dampers. HVAC dampers are tested by temperature feedback within the overall system (i.e., if the air within a room is not reaching a preset temperature, the HVAC system, including dampers, must be checked). Fire/smoke dampers must be checked for positional certainty. Fire/smoke dampers, unlike HVAC dampers, function either in a fully open or fully closed position and, thus, extreme blade positions must be reachable and are regularly tested.

Published U.S. patent application 2002/0152298 A1 to Kitka et al. discloses a control system for operating and integrating building applications such as HVAC, lighting, access control, and security. Kitka discloses modulating HVAC dampers, but not fire control dampers. Published application 2002/0144537 A1 to Sharp et al. discloses an air monitoring system customized for a specific structure. The system includes remotely distributed sensor units which communicate with a central unit through a digital network or other communication links, such as a power line, or by wireless communication. Specific testing and monitoring of damper positions in a fire/smoke control system are not disclosed.

There is a need for a control, testing, and monitoring system that addresses the specific requirements of fire/smoke dampers. Such a system should be capable of easy integration into existing testing and monitoring systems that are part of a building and are used for security, lighting, or heating/air conditioning.

SUMMARY OF THE INVENTION

The present invention is a fire/smoke damper control system for use with one or more fire/smoke dampers. The control system preferably includes a local damper controller associated with each fire/smoke damper. The controller is capable of causing the opening and closing of the fire/smoke damper and is capable of receiving a signal indicative of successful opening or closing of the damper.

The control system also includes a remote router that is capable of controlling the operation on one or more local damper controllers. The control system is in circuit communication with each of the local damper controllers, preferably via a twisted wire communication circuit. The twisted wire communication circuit may have a daisy chain configuration or a star connection configuration. The control system may be used with existing fire/smoke dampers or may be part of an original installation.

In one embodiment of the invention, a smoke detector is associated with one or more of the fire/smoke dampers, preferably a single smoke detector is associated with a single fire/smoke damper. One or more fire/smoke dampers may have an associated smoke detector. The local damper controller is in circuit communication with the smoke detector.

In one embodiment, the control system is capable of validating the operation of one or more fire/smoke dampers. The remote router sends a signal to the local damper controller to interrupt power to a damper actuator associated with the fire/smoke damper. The local damper controller sends a signal to the remote router indicative of the position of the damper (generally indicative of a fully shut damper). The remote router then sends a signal to the local damper controller to restore power to the actuator, and the local damper controller sends a signal to the remote router indicative of the position of the fire/smoke damper (generally indicative of a fully open damper). This enables rapid identification of any damper problems and the locations of the identified problems.

The remote router is capable of sending these signals to a plurality of fire/smoke dampers singly or simultaneously. In one embodiment, the remote router sends the signals sequentially to a plurality of fire/smoke dampers to sequentially interrupt power and then restore power to the associated damper actuator.

The fire/smoke damper control system is capable of periodically validating the satisfactory operation of one or more fire/smoke dampers at predetermined intervals.

In one embodiment, the control system is capable of being configured for communication with a building management system and may be configured to communicate with a computer network, such as a local area network, a wide area network, the internet, etc.

DETAILED DESCRIPTION OF THE PREFERRED AND ALTERNATE EMBODIMENTS

Figure 1:
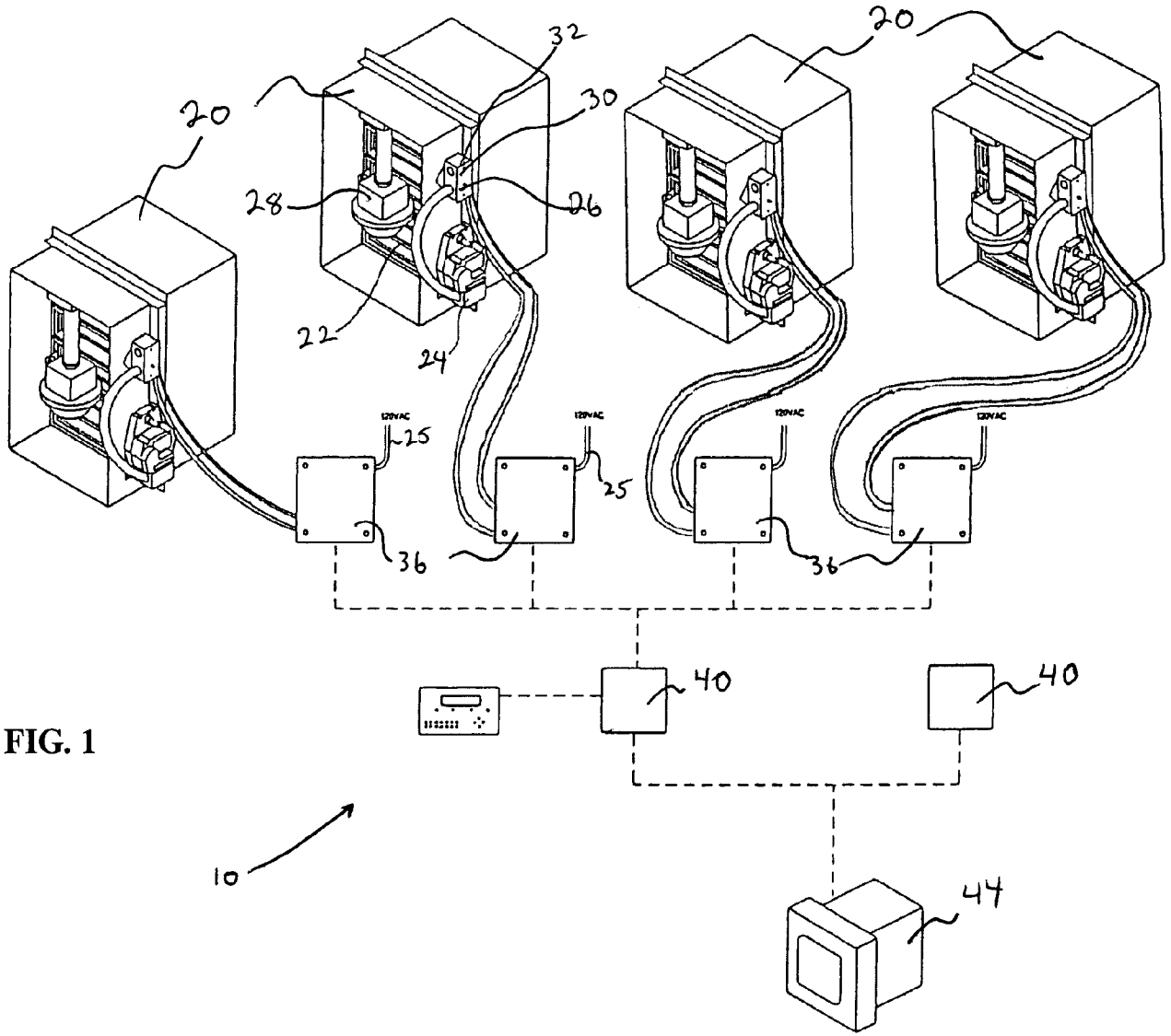
FIG. 1 is a schematic diagram showing a fire/smoke dampers as part of a control system.

FIG. 1 illustrates a fire/smoke damper control system 10. The system 10 is capable of monitoring and controlling at least one fire/smoke damper 20 and associated devices within a building. A fire/smoke damper 20 may be a damper which is designed to limit the spread of fire, smoke, or both. Each fire/smoke damper 20 is in circuit communication with a local damper controller 36, which is in circuit communication with a remote router 40. Preferably, the router 40 is in circuit communication with more than one local damper controller 36. In a preferred embodiment, the router 40 is in circuit communication with a building management system 44, but the control system 10 may also be remotely accessed, such as via the internet, for remote monitoring and adjusting.

"Circuit communication" as used herein indicates a communicative relationship between devices. Direct electrical, electromagnetic, and optical connections and indirect electrical, electromagnetic, and optical connections are examples of circuit communication. Two devices are in circuit communication if a signal from one is received by the other, regardless of whether the signal is modified by some other device. For example, two devices separated by one or more of the following—amplifiers, filters, transformers, optoisolators, digital or analog buffers, analog integrators, other electronic circuitry, fiber optic transceivers, or even satellites—are in circuit communication if a signal from one is communicated to the other, even though the signal is modified by the intermediate device(s). As another example, an electromagnetic sensor is in circuit communication with a signal if it receives electromagnetic radiation from the signal. As another example, two devices not directly connected to each other, but both capable of interfacing with a third device, e.g., a CPU, are in circuit communication. The term "preferably" as used herein is intended to mean preferably, but not necessarily.

The system 10 is capable of use to validate operation of the fire/smoke dampers 20 initially after installation and periodically during regular building use, and is capable of monitoring the dampers 20 constantly for failure and emergency conditions, such as those which occur during a fire.

FIG. 1 illustrates a typical fire/smoke damper 20, such as Model #FSD36 available from Ruskin Company. The fire/smoke damper 20 is placed within an air duct (not shown) and functions to prevent the spread of fire and/or smoke in an emergency situation. The damper 20 includes a plurality of louvers 22 that, when moved to a closed position, block the flow of smoke and/or fire through the air duct. In one embodiment, the louvers 22 are moved by an actuator 24 between a fully open and fully closed position. Preferably, the actuator 24 is a motor.

In a preferred embodiment, power to the dampers 20 is supplied by a local power source 25, such as a nearby power circuit in the building power supply. Thus, it is unnecessary to provide a dedicated power cable making a circuitous route from damper 20 to damper 20. As illustrated in FIG. 1, power is supplied to the damper 20 via the local damper controller 36, which is generally connected to the fire/smoke damper 20 with flexible conduit and cable. If power to the actuator 24 is interrupted, the louvers 22 will close.

An optional smoke detector 28 is associated with the control system 10. The smoke detector 28 is mounted on or near the fire/smoke damper 20 and is in circuit communication with the actuator 24 and the local damper controller 36. When the smoke detector 28 is triggered by sensing a predetermined smoke value, a signal is sent to the actuator 24 to close the fire/smoke damper 20 and an alarm signal is sent to the local damper controller 36. The alarm signal is transmitted to the router 40 and the building management system 44.

Preferably, the damper 20 is also equipped with a high temperature cut-out switch 26 wired in series with the actuator 24. If the temperature exceeds the switch 26 cut-out setpoint, contacts in the switch 26 will open and the actuator 24 will be de-energized. This causes the damper 20 to close. A signal is sent to the local damper controller 36, the router 40, and the building management system 44 to indicate that the damper 20 is closed.

The damper 20 also includes a damper fully closed switch 30 and a damper fully open switch 32. Preferably, these switches are limit switches. When the louvers 22 of the damper 20 are in a fully open or closed position, the corresponding switch is tripped. The local controller 36 is able to sense electronically when the switches 30 and 32 are tripped.

The local controller 36 is in circuit communication with the damper 20 and the router 40. In a preferred embodiment of the invention, one local controller 36 is provided for each fire/smoke damper 20. In other embodiments of the invention, not shown, a single local controller may be used with multiple dampers.

The local controller 36 is preferably powered by 120 VAC power at 50/60 Hertz and 6.5 amps. Power is typically provided from a local source (i.e., from wiring in the building located close to the controller), but may also be provided by a dedicated line which runs from local controller to local controller. The local controller 36 includes at least one serial port for communications purposes.

The local controller 36 is capable of controlling the damper 20 by opening and closing louvers 22 for test (validation) purposes and closing louvers 22 in emergency situations. During validation, the louvers 22 may be closed on a preset schedule to sequentially test dampers 20 at a prescribed time interval. The local controller 36 also controls the damper 20 by collecting data relating to louver position (open/closed/neither) and signals from local smoke detectors 28.

The local controller 36 may include a manually adjustable numeric indicator which can be set to identify the adjacent fire/smoke damper 20 as well as the controller 36 attached thereto. Preferably, the numeric indicator has a range from 01 through 99. The indicator enables the router 40 and the building management system 44 to identify a specific controller 36 and its associated damper 20, which aids in troubleshooting problems within the system.

The remote router 40 controls the operation of one or more local damper controllers 36 and enables communication between the damper controllers 36 and the building management system 44. In one embodiment, the remote router 40 controls up to 99 local damper controllers 20. The router 40 reports abnormal conditions to maintenance or monitoring personnel via the building's management system 44 and/or a local panel 50, described below. The router 40 is powered with 24 VAC, 7.2 VA, 50/60 Hertz supplied by a 120 vac/24 vac transformer, but other power parameters may be selected without departing from the spirit and scope of the invention to accommodate particular situations.

The router 40 is preferably programmable to perform periodic testing of the fire/smoke dampers 20. Such testing generally includes testing of the open/close damper function and position testing of damper louvers. The remote router 40 may act simply as a protocol translator between the building management system 44 and the individual damper controllers 20. For example, testing routines may be programmed into the building management system 44 and instructions sent by the building management system 44 at the appropriate time to the damper controllers 20 via the router 40. Testing routines may also be sent to the router 40 or building management system 44 from an off site location, such as via the Internet. Results of the tests, similarly, can be sent to the off site location. Control and testing software may reside either on the router 40 or within the building management system 44.

In a preferred embodiment, the router 40 includes a manually adjustable numeric indicator that can be identified by the building management system 44. The router 40 typically includes one Ethernet port and one serial port for communication. The router 40 also includes 1 MB of flash memory and 2 MB non-volatile battery-backed RAM. The battery is a seven-year lithium type. The specific ports, memory, and battery may be selected based on the specific operating conditions encountered without departing from the spirit or scope of the invention.

Figure 2:
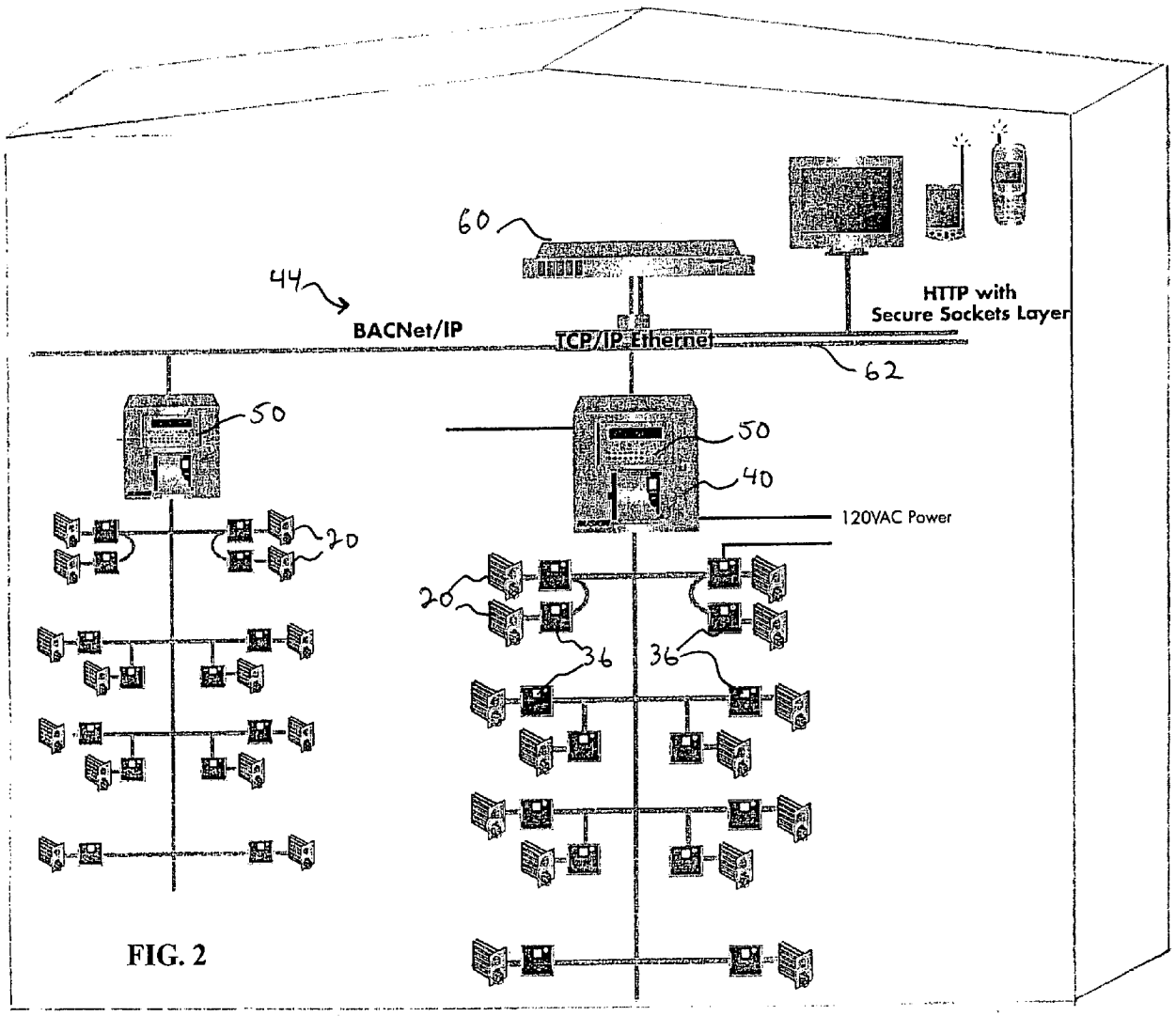
FIG. 2 is a schematic showing a control system within a building.
Figure 5:
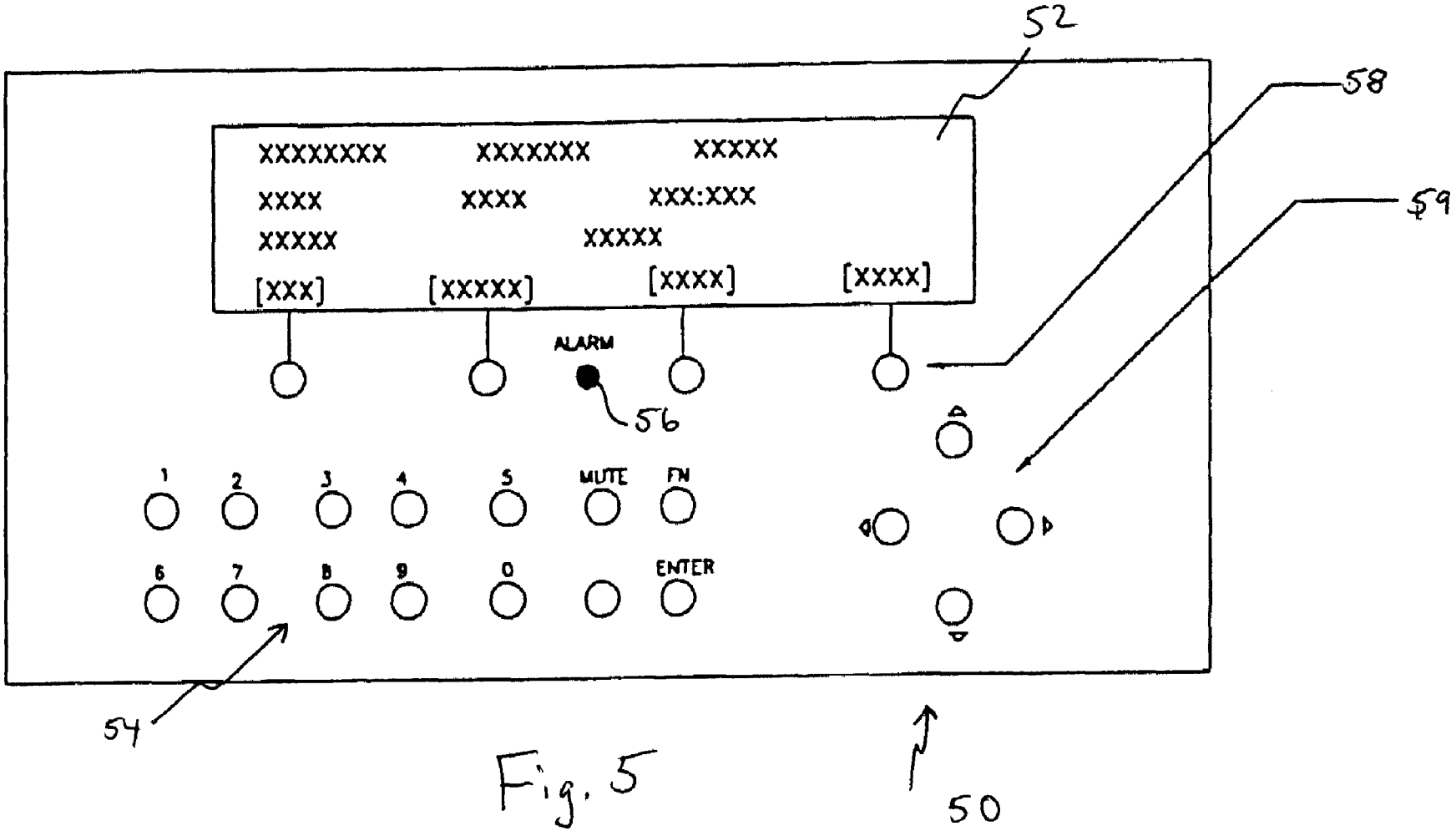
FIG. 5 is a representation of a local panel in accordance with the present invention.

As shown in the embodiment illustrated in FIGS. 2 and 5, the router 40 is provided with a local panel 50. The local panel 50 is powered by 24 VAC, 8.4 VA, 50/60 Hz power, but any appropriate power supply may be used. Preferably, connection between the local panel 50 and the router 40 is made via a fourteen conductor ribbon cable.

The local panel 50 provides for localized viewing of the system parameters via a display 52 and allows these parameters to be changed locally via a keypad 54. The local panel 50 includes the display 52, an alarm indicator light 56, and an audible warning device (not shown). The display 52 is preferably an LCD display with a 4 line by 40 character viewing screen. The keypad 54 preferably includes function keys 58 and directional keys 59.

The local panel 50 is used to monitor and clear alarms, manually validate one or more dampers 20, change validation schedules, and change clock settings in the system as described in more detail below. Access to the local panel 50 may be password protected.

Figure 3:
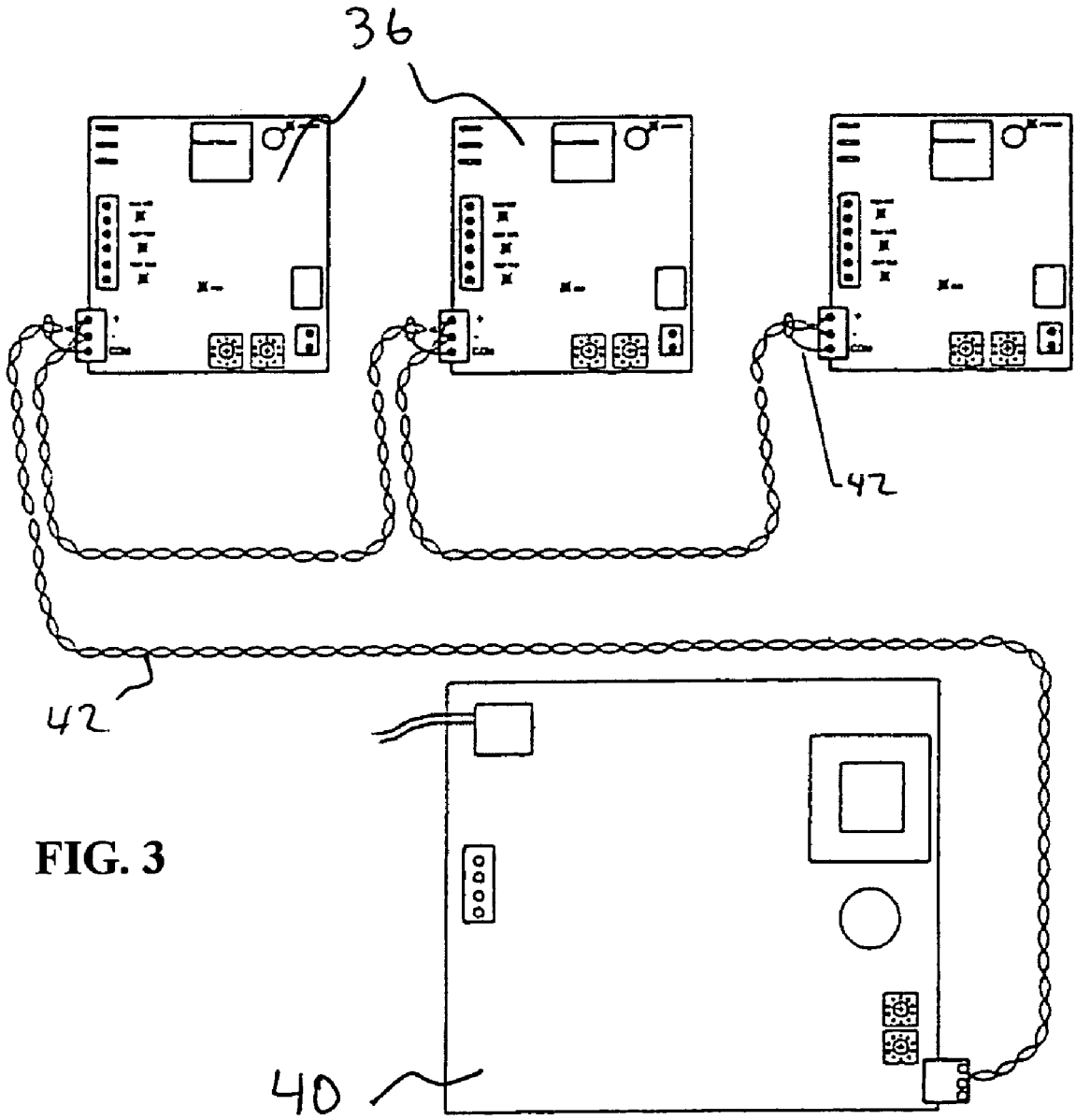
FIG. 3 is a wiring schematic of one embodiment of a control system.
Figure 4:
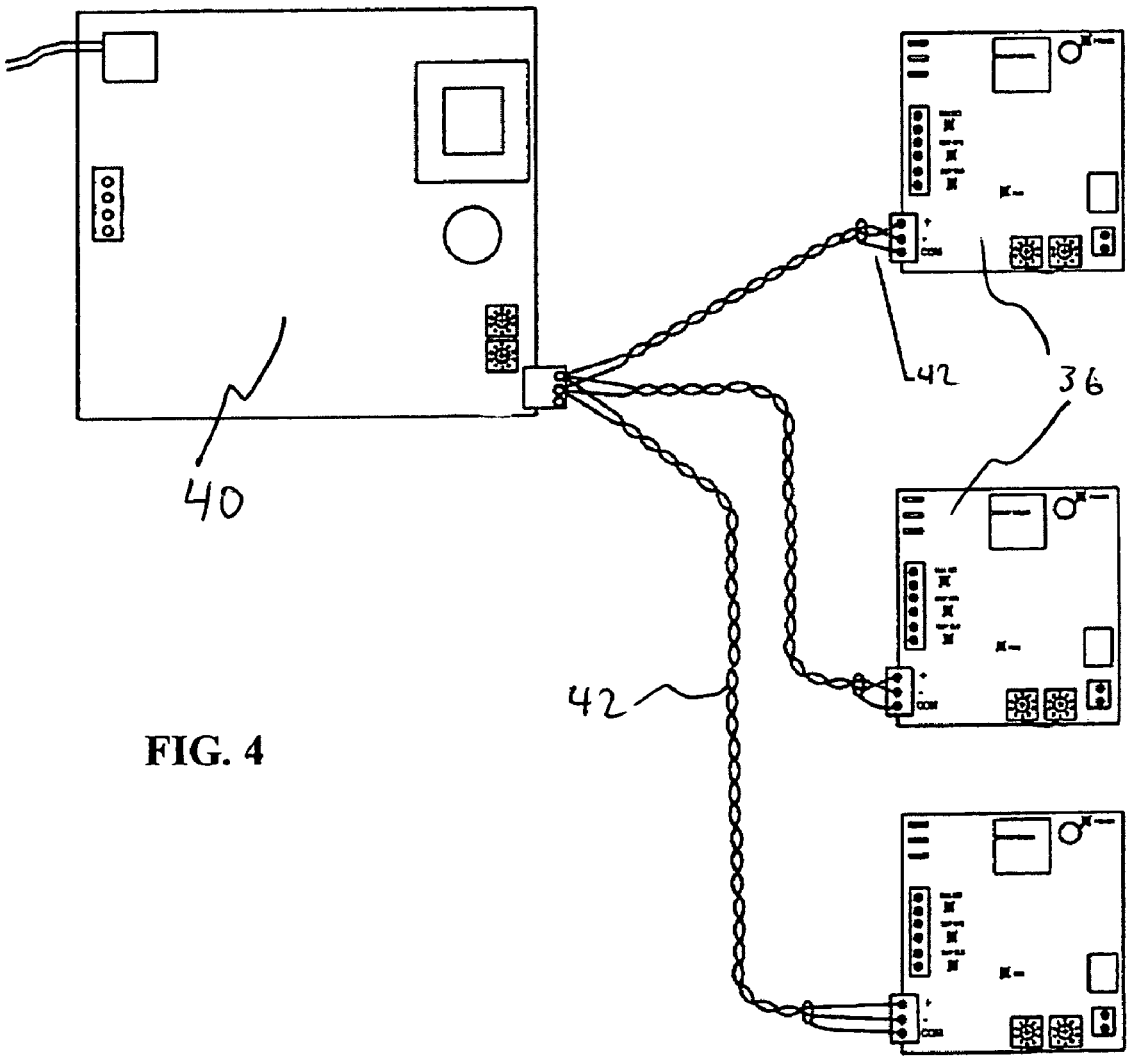
FIG. 4 is a wiring schematic of another embodiment of the a control system.

A shielded twisted pair cable 42 is used to connect the group of local controllers 36 together and local controllers 36 to a router 40, as illustrated in FIGS. 3 and 4. The shielded twisted pair cable 42 may be configured in a daisy chain, parallel, or star connection pattern. FIG. 3 illustrates a daisy chain configuration and FIG. 4 illustrates a star connection pattern configuration. The shielding wire of the twisted pair 42 is grounded at one end only. Other wiring arrangements may also be used without departing from the spirit and scope of the invention.

Figure 6:
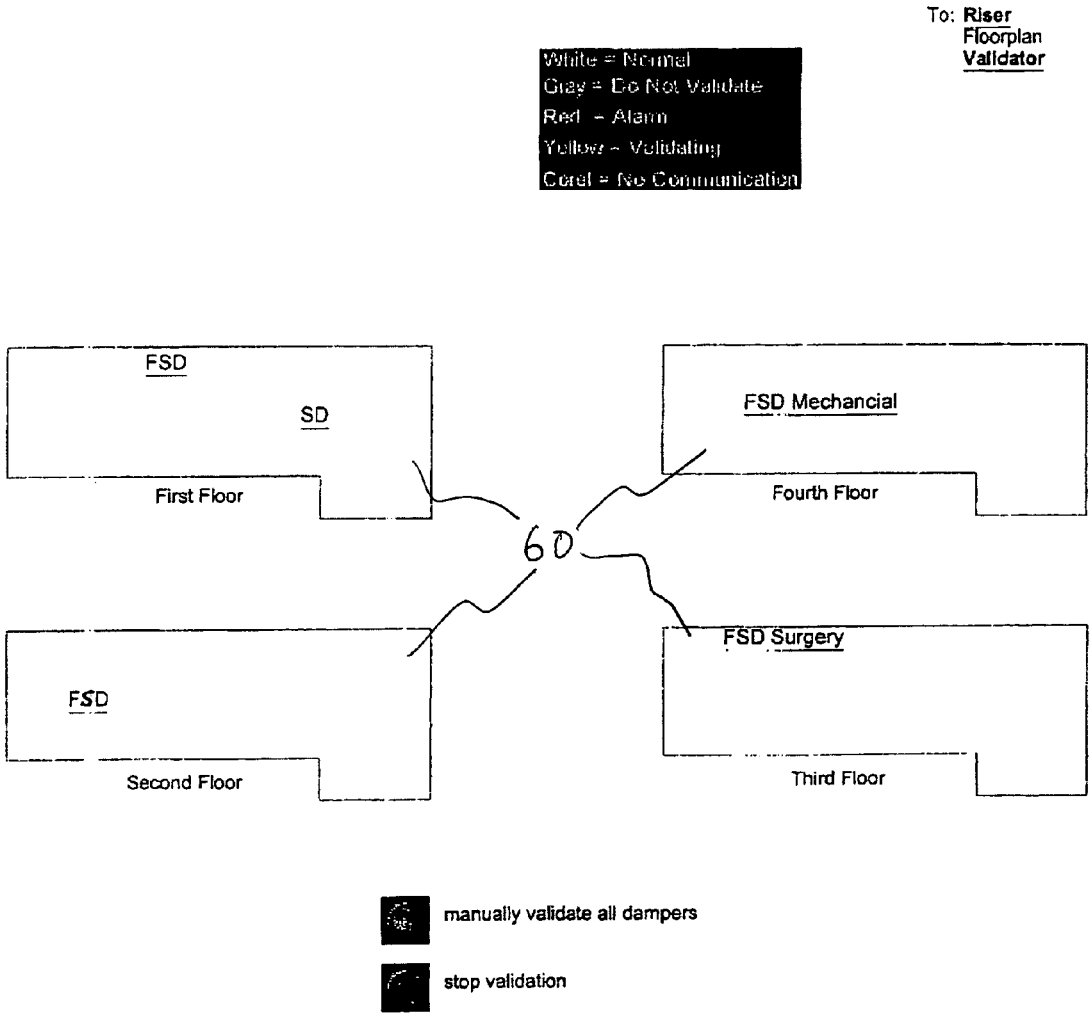
FIG. 6 is a floor plan schematic representing a control system within a building.

The router 40 supports software for use with the local panel 50 and/or within the building management system 44. The software provides numerous graphic screens for use in understanding and controlling the system as described below. These graphic screens include a riser display (cutaway view of the building showing critical damper locations), floor plan view, and graphic of individual damper. FIG. 6 illustrates an example floor plan view, including four separate floors 60. Each floor includes a representation of the fire/smoke damper (FSD) and/or smoke/damper (SD) located on that floor. A color coding system may be used to indicate the status of each damper. For example, a white color around the damper symbol may indicate the damper is operating normally. A gray color may indicate that the damper is not included in the testing scheme. A yellow color may indicate that the actual validation process is currently being executed. A red color may indicate an alarm status (damper malfunction, smoke detected, high temperature detected). A pink color may indicate that the damper is part of the testing scheme, but no signals are being received from the local damper controller. Validation schemes may be started or interrupted by indicator buttons, which may be part of the schematic display. The software also provides clear indicators of alarms and the means to accept/reset alarm conditions.

In a typical configuration during normal operation, the fire/smoke damper 20 is maintained in an open position. The damper 20 will be closed in emergency situations indicated by smoke detection, sensing of excessive heat, or loss of power to the damper actuator 24.

Operation of the fire/smoke dampers 20 should periodically be validated on a schedule selected by the building operator and programmed into either the building management system 44 or the router 40. Validation of a damper 20 occurs by interrupting the power supplied to the actuator 24 upon an individual damper. The damper 20 should close automatically and the fully closed switch 30 tripped. Power is then restored to the damper actuator 24, which should move the damper 20 to a fully open position. At this point the fully open switch 32 should be tripped. Each time a switch is tripped a signal is provided to the local controller 36. Signals representative of these results are sent to the building management system 44 and/or the local panel 50. An operator may then take appropriate action based on these signals. In one embodiment, the signals are also available outside the building management system via remote access to the system. A recod of these signals may also be stored for future review.

If there are malfunctions within the control system 10, alarm signals are created. These alarm signals include:

damper fails to fully close in validation, damper fails to fully open in validation;

damper does not exist in either a fully open or closed position;

damper closes during normal operation;

smoke detected;

excessive heat detected;

communication link to the local controller has been lost; and testing Jumper cables left on damper.

The testing of the dampers 20 is preferably sequenced so disruption of ventilation is kept to a minimum. The testing schedule and scheme may be amended via the building management system 44 or the router 40.

If an abnormal condition occurs, such as a damper 20 closed when not being tested, or not fully open, this is an alarm condition and will be reported to the building management system 44. If a smoke detector 28 is being used and is connected to the local damper controller 36, an alarm condition will occur if the smoke detector 28 trips. This will also be reported to the building management system 44. For both testing and alarm conditions, the control system 10 identifies the damper 20 being monitored based on the damper identification described above.

Data and settings for each damper 20 may be obtained or made via the local panel 50 or through the building management system 44. These data and settings include:

confirm damper has normally open operation;

include/remove in validation scheme;

manually validate a damper, change the schedule of testing, and adjust clock settings.

The routers 40 are preferably in circuit communication with a network 62 as a part of or separate from the building management system 44. The routers 40 also may be controlled remotely via a server 60 in communication with the building management system 44 and the network 62. Access may also be obtained through a hard wired or wireless web browser connection. Such access may be limited via a system specific numeric address. Viewing on the monitor of an internet or server based system may include graphical and schematic representations of the dampers, controllers, routers as well as the building (cutaway or floorplan) in which they reside. Via the monitor and a keyboard, an operator may view alarms, reset alarms, manually validate dampers, or lock out any dampers from an overall test scheme. The validation process can be represented graphically upon the display screen.

Although the invention has been shown and described with reference to certain preferred and alternate embodiments, the invention is not limited to these specific embodiments. Minor variations and insubstantial differences in the various combinations of materials and methods of application may occur to those of ordinary skill in the art while remaining within the scope of the invention as claimed and equivalents. Use of the term "or" herein is the inclusive and not the exclusive use.

The invention claimed is:

1. A method of validating the operation of one or more fire/smoke dampers comprising:

sending a signal from a remote router to a local damper controller controlling a single fire/smoke damper instructing the local damper controller to interrupt power to a damper actuator;

sending a signal from the local damper controller to the router indicative of whether the fire/smoke damper reached a fully open or fully closed position after power was interrupted;

sending a signal from the remote router to the local damper controller instructing the local damper controller to restore power to the actuator; and sending a signal from the local damper controller to the router indicative of whether the fire/smoke damper reached a fully closed or fully open position opposite of the position reached when power to the actuator was interrupted.

2. The method of claim 1 wherein the remote router is capable of sending signals to a plurality of local damper controllers, singly or simultaneously.

3. The method of claim 1 further comprising sequentially sending signals from the router to a plurality of local damper controllers to sequentially interrupt power to the plurality of damper controllers.

4. The method of claim 1 further comprising initiating the signal from the remote router to interrupt power to the actuator from a local panel in circuit communication with the router.

* * * * *